US006137390A

United States Patent [19]

Tung et al.

[11] Patent Number: 6,137,390

[45] Date of Patent: Oct. 24, 2000

[54] INDUCTORS WITH MINIMIZED EMI EFFECT AND THE METHOD OF MANUFACTURING THE SAME

[75] Inventors: Mean-Jue Tung; Yu-Ting Huang, both of Hsinchu, Taiwan

[73] Assignee: Industrial Technology Research Institute, Hsinchu Hsien, Taiwan

[21] Appl. No.: 09/304,471

[22] Filed: May 3, 1999

[51] Int. Cl.[7] ..... H01F 22/02

[52] U.S. Cl. ..... 336/83; 336/96; 336/84

[58] Field of Search ..... 336/96, 83, 84

[56] References Cited

U.S. PATENT DOCUMENTS

| | | | |
|---|---|---|---|
| 4,414,288 | 11/1983 | Kawahara et al. | 428/694 BY |
| 4,595,901 | 6/1986 | Yahagi | 336/192 |
| 4,704,592 | 11/1987 | Marth et al. | 336/83 |
| 5,166,655 | 11/1992 | Rodgers | 336/83 |
| 5,266,739 | 11/1993 | Yamauchi | 174/52.2 |
| 5,450,052 | 9/1995 | Goldberg et al. | 336/83 |
| 5,680,087 | 10/1997 | Sakata et al. | 336/83 |

*Primary Examiner*—Michael L. Gellner
*Assistant Examiner*—Anh Mai
*Attorney, Agent, or Firm*—W. Wayne Liauh

[57] ABSTRACT

An inductor with enhanced inductance and reduced electromagnetic inductance (EMI) interference. It contains: (a) a magnetic core; (b) an electrically conducting coil wound about the magnetic core; and (c) a magnetic resin layer compression-molded to embed at least a portion of the outer periphery of the electrically conducting coil. The magnetic resin contains a magnetic powder dispersed in a polymer resin. For relatively low inductance inductors, instead of being of a hard metal rod, the magnetic core can be made of the same material as the magnetic resin. The inductance of the inductor can be controlled by controlling the magnetic permeability of the magnetic resin or the thickness of the magnetic resin layer, or both. The magnetic core can be a magnetic metal/metal oxide core, or a consolidated magnetic core made of the same or different magnetic resin as the magnetic resin layer. A metal magnetic sheath can be further provided outside of the magnetic resin layer.

20 Claims, 1 Drawing Sheet

INDUCTORS WITH MINIMIZED EMI EFFECT AND THE METHOD OF MANUFACTURING THE SAME

FIELD OF THE INVENTION

The present invention relates to an improved inductor with improved inductance and minimized electromagnetic induction (EMI) interference, and the method of manufacturing the same. More specifically, the present invention relates to a method for manufacturing improved inductors which provide substantially increased inductance while exhibiting substantially reduced magnetic leakage as well as substantially minimized EMI interference when compared to those made with conventional methods. Another advantage of the method disclosed in the present invention is that it does not require high temperature sintering, and can achieve these desirable properties in a very cost effective manner without involving complicated molding, fabrication, coiling, or packaging steps.

BACKGROUND OF THE INVENTION

Inductors are considered one of the most common devices in the electronic/electric industry. An inductor is an electronic component designed to provide a controlled amount of inductance. An inductor generally consists of a length of wire wound into a solenoid (i.e., cylindrically-shaped) or toroidal (i.e., drum-like) shape. The inductance may be increased by placing a core with high magnetic permeability within the coil. Suitable core materials include iron, ferromagnetic alloys, and oxides thereof, and mixtures thereof. Commercially made inductors typically have inductance values ranging from less than 2.2 nH to about 10 H. Small inductors are commonly used in radio-frequency tuned circuits and as radio-frequency chokes. Large inductors are employed at audio frequencies.

With the constant demand for miniaturization of essentially every consumer electronic device, manufacturers of inductors are facing a tremendous pressure to minimize the size of inductors, while, at the same time, providing the same or even higher value of inductance, reducing electromagnetic induction interference that may exist with respect to other electronic devices, and minimizing magnetic leakages. At the present time, there does not appear to be a solution that will satisfy all these needs without substantially increasing the manufacturing cost and substantially increasing the complexity of the manufacturing process.

SUMMARY OF THE INVENTION

The primary object of the present invention is to develop an inductor with increased inductance per unit volume while minimizing the undesirable electromagnetic induction (EMI) interference and magnetic leakage. More specifically, the primary object of the present invention is to develop a cost effective method for manufacturing improved electronic inductors which provide improved inductance per unit volume and exhibit substantially reduced EMI interference and magnetic leakage.

Superior unexpected results were observed by the co-inventors of the present invention when a conventional induction coil was compress-molded with a layer of a magnetic resin mixture which contains a magnetic powder dispersed in a polymer resin. The magnetic powder can be any ferromagnetic metal or metal oxide, or mixture thereof. The polymer resin can be a thermosetting resin such polyamide, polyimide, or epoxy resin, or it can be a thermoplastic resin such as polyethylene, polypropylene, etc.

One of the advantages of the method disclosed in the present invention is that the inductance of the coil can be controlled by adjusting the magnetic permeability of the magnetic-resin mixture, and/or the thickness of the magnetic-resin layer. By using the compression molding process, the void space in the entire inductor is minimized. This minimizes the EMI interference and magnetic leakage, and increases the inductance per unit volume.

The embodiment of the inductor of the present invention as discussed above can be modified by sleeving a ferromagnetic sheath outside the magnetic resin layer. This modification can further increase the inductance of the inductor so prepared.

In yet another modification of the process of the present invention, the magnetic core can be eliminated and the entire conducting coil is embedded inside a matrix of the magnetic-resin mixture. This is embodiment is most advantageous for manufacturing inductors wherein the required valve of inductance is only moderate. This embodiment eliminates the need for a high-temperature sintering process, it also eliminates many of the commonly encountered problems involving molding, fabrication, coiling, and packaging, etc.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

The present invention discloses a novel inductor which provides substantially increased inductance per unit volume while minimizing the electromagnetic induction (emi) interference and magnetic leakage. One of the advantages of the novel inductors of the present invention is that the inductance of the inductors can be conveniently controlled by adjusting the magnetic permeability of the magnetic-resin mixture, and/or by adjusting the thickness of the magnetic-resin layer which embeds the coil. The magnetic-resin layer is implemented using a compression molding process, which causes the void space in the entire inductor to be minimized. This minimizes the EMI interference and magnetic leakage, and increases the inductance per unit volume.

Figure 1:
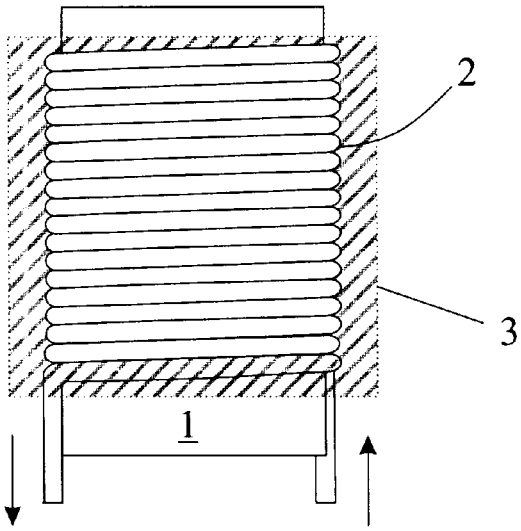
FIG. 1 is a schematic front view of the improved inductor according to a first preferred embodiment of the present invention, which includes a layer of magnetic-resin mixture compression molded to embed a conventional inductor.
Figure 2:
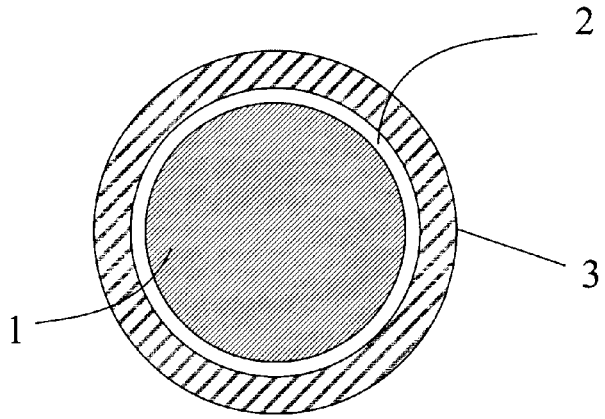
FIG. 2 is a schematic longitudinal cross-sectional view of the improved inductor as shown in FIG. 1 which contains a ferromagnetic core, a conducting coil, and a magnetic-resin layer compression molded to embed the ferromagnetic core and the conducting coil.

FIG. 1 is a schematic front view of the improved inductor according to a first preferred embodiment of the present invention, which includes a layer of magnetic-resin mixture 3 compression-molded to enclose a conventional inductor coil 2 wound about a magnetic core 1. While FIG. 1 shows that he magnetic-resin mixture layer 3 only partially encloses the entire magnetic core 1 , it can be made to completely enclose the entire magnetic core 1. And FIG. 2 is a schematic longitudinal cross-sectional view of the improved inductor as shown in FIG. 1 which contains a ferromagnetic core 1, a conducting coil 2, and a magnetic resin layer 3 compression molded to embed (i.e., enclose in matrix) the ferromagnetic core 1 and the conducting coil 2. The magnetic core 1 can be a metal or metal oxide magnetic core made of a ferromagnetic metal, a metal alloy, a ferrimagnetic metal oxide powder, or a mixture thereof. As it will be discussed below, the magnetic core 1 can also be a consolidated magnetic core made of the same material as the magnetic resin layer.

In the process to prepare the novel inductor of the present invention, a conventional induction coil is compression-molded with a layer of a magnetic resin mixture which contains a magnetic powder dispersed in a polymer resin. In the compression-molding process, the conventional induction coil with the magnetic core is first placed inside a mold, then the magnetic resin is poured into the mold, which is then compressed to the final dimension.

The magnetic core and the magnetic powder can be any ferromagnetic metal, alloy, or metal oxide, or mixture thereof. Preferred metals or alloys include iron, silicon/iron, cobalt/iron, nickel/iron, etc. Preferred metal oxides include magnesium/zinc, copper/zinc, nickel/zinc series ferrites. The polymer resin can be a thermosetting resin such polyamide, polyimide, or epoxy resin, or it can be a thermoplastic resin such as polyethylene or polypropylene. Superior unexpected results, including increased inductance and reduced EMI effect and magnetic leaks, were observed when a conventional inductor is compression-molded to form such a layer of the magnetic resin. The extent of the inductance enhancement and reduction in magnetic leakage can be controlled by properly adjusting the thickness of the magnetic-resin layer and/or the magnetic permeability of the magnetic-resin.

The inductor of the present invention as discussed above can be modified by sleeving a ferromagnetic sheath outside the magnetic resin layer. This modification can further increase the inductance of the inductor so prepared.

Figure 3:
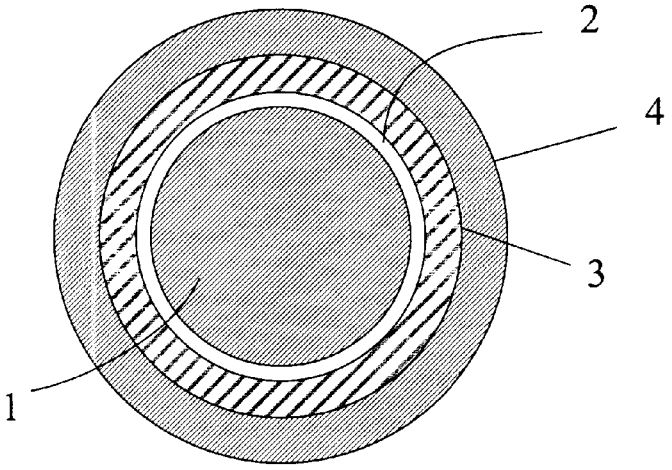
FIG. 3 is a schematic longitudinal cross-sectional view of the improved inductor according to the second preferred embodiment of the present invention which further contains a ferromagnetic sleeve outside of the magnetic-resin layer.

FIG. 3 is a schematic top view of the improved inductor according to the second preferred embodiment of the present invention which further contains a ferromagnetic sleeve, or sheath, 4 outside of the magnetic-resin layer. Such an outmost magnetic sheath can further increase the inductance of the inductor.

In yet another modification of the process of the present invention, the magnetic core can be eliminated and the entire conducting coil is embedded inside a matrix of the magnetic-resin mixture. This is embodiment is most advantageous for manufacturing inductors wherein the required value of inductance is only moderate. This embodiment eliminates the need for a high-temperature sintering process, it also eliminates many of the commonly encountered problems involving molding, fabrication, coiling, and packaging, etc. This process involves placing the coil only into the compression mold, followed by the step of pouring the magnetic resin into the mold to enclose the coil.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

COMPARATIVE EXAMPLE A

A conducting coil is wound around a magnetic core having a relative magnetic permeability $U_r$ of 1,000, to form an inductor. The wound coil has a thickness of 1 mm and a length of 8 mm. The inductor is measured to have an inductance per winding turn of 14.1 nH.

EXAMPLES A1–A10

The inductors in Examples A1 through A10 are identical to that of Comparative A, except that a magnetic resin layer of varying thickness is formed to embed and enclose the conducting coil. The magnetic resin has a relative magnetic permeability $U_r$ of 50. The total outside diameters of the inductors of Examples A1 through A10 are 7, 8, 9, 10, 11, 12, 13, 14, 15, and 20, respectively, and the measured inductances per winding turn are 78.9, 121, 152, 172, 187, 197, 204, 209, 213, and 220 nH, respectively, representing factors of inductance enhancement of 5.6, 8.6, 10.8, 12.3, 13.3, 14.0, 14.5, 14.9, 15.1, and 15.6, respectively. Results of the tests are summarized in Table A.

TABLE A

| Example No. | Total Inductor Outside Diameter (mm) | Inductance per unit winding turn (nH) | Enhancement in Inductance |
|---|---|---|---|
| A1 | 7 | 78.9 | 5.6 |
| A2 | 8 | 121 | 8.6 |
| A3 | 9 | 152 | 10.8 |
| A4 | 10 | 172 | 12.3 |
| A5 | 11 | 187 | 13.3 |
| A6 | 12 | 197 | 14.0 |
| A7 | 13 | 204 | 14.5 |
| A8 | 14 | 209 | 14.9 |
| A9 | 15 | 213 | 15.1 |
| A10 | 20 | 220 | 15.6 |

COMPARATIVE EXAMPLE B

A conducting coil is wound around a magnetic core having a relative magnetic permeability $U_r$ of 1,000 to form an inductor. The wound coil has a thickness of 2 mm and a length of 8 mm. The inductor per winding turn is measured to provide an inductance of 13.2 nH.

EXAMPLES B1–B8

The inductors in Examples B1 through B8 are identical to that of Comparative B, except that a magnetic resin layer of varying thickness is formed to embed and enclose the conducting coil. The magnetic resin has a relative magnetic permeability $U_r$ of 50. The total outside diameters of the inductors of Examples B1 through B8 are 9, 10, 11, 12, 13, 14, 15, and 20, respectively, and the measured inductances per winding turn are 86.2, 120, 141, 155, 163, 169, 173, and 181 nH, respectively, representing factors of inductance enhancement of 6.5, 9.1, 10.7, 11.7, 12.3, 12.8, 13.1, and 13.7, respectively. Results of the tests are summarized in Table B.

TABLE B

| Example No. | Total Inductor Outside Diameter (mm) | Inductance per unit winding turn (nH) | Enhancement in Inductance |
|---|---|---|---|
| B1 | 9 | 86.2 | 6.5 |
| B2 | 10 | 120 | 9.1 |
| B3 | 11 | 141 | 10.7 |
| B4 | 12 | 155 | 11.7 |
| B5 | 13 | 163 | 12.3 |
| B6 | 14 | 169 | 12.8 |
| B7 | 15 | 173 | 13.1 |
| B8 | 20 | 181 | 13.7 |

EXAMPLES C1–C10

The inductors in Examples C1 through C10 are identical to that of Comparative A, except that a magnetic resin layer of varying thickness is formed to embed and enclose the conducting coil. The magnetic resin has a relative magnetic permeability $U_r$ of 20. The total outside diameters of the inductors of Examples A1 through A10 are 7, 8, 9, 10, 11, 12, 13, 14, 15, and 20, respectively, and the measured inductances per winding turn are 42.6, 59.6, 72.0, 80.9, 87.2, 91.7, 94.9, 97.1, 98.8, and 102 nH, respectively, representing factors of inductance enhancement of 3.0, 4.2, 5.1, 5.7, 6.2, 6.5, 6.7, 6.9, 7.0 and 7.3, respectively. Results of the tests are summarized in Table C.

TABLE C

| Example No. | Total Inductor Outside Diameter (mm) | Inductance per unit winding turn (nH) | Enhancement in Inductance |
|---|---|---|---|
| C1 | 7 | 42.6 | 3.0 |
| C2 | 8 | 59.6 | 4.2 |
| C3 | 9 | 72.0 | 5.1 |
| C4 | 10 | 80.9 | 5.7 |
| C5 | 11 | 87.2 | 6.2 |
| C6 | 12 | 91.7 | 6.5 |
| C7 | 13 | 94.9 | 6.7 |
| C8 | 14 | 97.1 | 6.9 |
| C9 | 15 | 98.8 | 7.0 |
| C10 | 20 | 102 | 7.3 |

EXAMPLES D1–D8

The inductors in Examples D1 through D8 are identical to that of Comparative B, except that a magnetic resin layer of varying thickness is formed to embed and enclose the conducting coil. The magnetic resin has a relative magnetic permeability $U_r$ of 20. The total outside diameters of the inductors of Examples D1 through D8 are 9, 10, 11, 12, 13, 14, 15, and 20, respectively, and the measured inductances per winding turn are 45.3, 58.2, 66.5, 72.0, 75.7, 78.2, 80.0, and 83.6 nH, respectively, representing factors of inductance enhancement of 3.4, 4.4, 5.0, 5.4, 5.7, 5.9, 6.0, and 6.3, respectively. Results of the tests are summarized in Table D.

TABLE D

| Example No. | Total Inductor Outside Diameter (mm) | Inductance per unit winding turn (nH) | Enhancement in Inductance |
|---|---|---|---|
| D1 | 9 | 45.3 | 3.4 |
| D2 | 10 | 58.2 | 4.4 |
| D3 | 11 | 66.5 | 5.0 |
| D4 | 12 | 72.0 | 5.4 |
| D5 | 13 | 75.7 | 5.7 |
| D6 | 14 | 78.2 | 5.9 |
| D7 | 15 | 80.0 | 6.0 |
| D8 | 20 | 83.6 | 6.3 |

The above tables show that an enhancement of inductance ranging between 3.4 and 15.6 can be achieved with the novel design of the present invention.

EXAMPLES E1–E2

The inductors in Examples E1 and E2 are identical to those of Examples A4 and B2, respectively, except that a magnetic sheath having an inside diameter of 10 mm and an outside diameter of 14 mm, is formed enclosing the magnetic resin layer. The magnetic sheath has a relative magnetic permeability $U_r$ of 1,000. The measured inductances per winding layer are 247 and 209 respectively, representing factors of inductance enhancement of 17.5 (from 12.3 without the sheath) and 15.8 (from 9.1 without the sheath), respectively. Results of the tests are summarized in Table E.

TABLE E

| Example No. | Total Inductor Outside Diameter (mm) | Inductance per unit winding turn (nH) | Enhancement in Inductance |
|---|---|---|---|
| E1 | 1 | 247 | 17.5 |
| E2 | 2 | 209 | 15.8 |

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. An inductor with enhanced inductance comprising:

(a) a magnetic core;

(b) an electrically conducting coil wound about said magnetic core;

(c) a magnetic resin layer compression-molded to embed at least a portion of an outer periphery of said electrically conducting coil;

(d) wherein said magnetic resin layer contains a magnetic powder dispersed in a polymer resin.

2. The inductor according to claim 1 wherein said magnetic resin layer has a thickness determined matching a predetermined inductance of said inductor.

3. The inductor according to claim 1 wherein said magnetic core is a metal or metal oxide magnetic core.

4. The inductor according to claim 1 wherein said magnetic core is made of a ferromagnetic metal, a metal alloy, a ferrimagnetic metal oxide, or a mixture thereof.

5. The inductor according to claim 1 wherein said magnetic core is a compression molded magnetic core made of the same or different magnetic resin as said magnetic resin layer.

6. The inductor according to claim 1 which further comprises a metal magnetic sheath outside of said magnetic resin layer.

7. The inductor according to claim 1 wherein said polymer resin is a thermosetting polymer.

8. The inductor according to claim 1 wherein said polymer resin is a thermoplastic polymer.

9. The inductor according to claim 1 wherein said magnetic resin layer buries both said magnetic core and said electrically conducting coil.

10. The inductor according to claim 1 wherein said magnetic powder is made of a ferromagnetic metal powder, a metal alloy powder, a ferrimagnetic metal oxide powder, or a mixture thereof.

11. A method for making inductors with enhanced inductance comprising the steps of:

(a) winding an electrically conducting coil about a magnetic core;

(b) forming a magnetic resin layer by compression molding to embed at least a portion of an outer periphery of said electrically conducting coil;

(c) wherein said magnetic resin matrix contains a magnetic powder dispersed in a polymer resin.

12. The method for making inductors according to claim 11 wherein said magnetic resin layer has a thickness determined by a required inductance of said inductor.

13. The method for making inductors according to claim 11 wherein said magnetic core is a metal or metal oxide magnetic core.

14. The method for making inductors according to claim 11 wherein said magnetic core is made of a ferromagnetic metal, a metal alloy, a ferrimagnetic metal oxide, or a mixture thereof.

15. The method for making inductors according to claim 11 wherein said magnetic core is a consolidated magnetic core made of the same or different magnetic resin as said magnetic resin layer.

16. The method for making inductors according to claim 11 which further comprises the step of forming a metal magnetic sheath outside of said magnetic resin layer.

17. The method for making inductors according to claim 11 wherein said polymer is a thermosetting polymer.

18. The method for making inductors according to claim 11 wherein said polymer is a thermoplastic polymer.

19. The method for making inductors according to claim 11 wherein said magnetic resin layer is formed to bury both said magnetic core and said electrically conducting coil.

20. The method for making inductors according to claim 11 wherein said magnetic powder is made of a ferromagnetic metal powder, a metal alloy powder, a ferrimagnetic metal oxide powder, or a mixture thereof.

* * * * *